US006951510B1

(12) United States Patent
Rodriguez et al.

(10) Patent No.: US 6,951,510 B1
(45) Date of Patent: Oct. 4, 2005

(54) CHEMICAL MECHANICAL POLISHING PAD WITH GROOVES ALTERNATING BETWEEN A LARGER GROOVE SIZE AND A SMALLER GROOVE SIZE

(75) Inventors: Jose Omar Rodriguez, Orlando, FL (US); Charles A. Storey, Orlando, FL (US); John F. Thompson, Orlando, FL (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 10/799,279

(22) Filed: Mar. 12, 2004

(51) Int. Cl.[7] ..... B24B 1/00

(52) U.S. Cl. ..... 451/56; 451/285; 451/288; 451/527

(58) Field of Search ..... 451/56, 72, 28, 451/65, 285–289, 527, 548–550; 51/307, 51/298

(56) References Cited

U.S. PATENT DOCUMENTS

| | | | | |
|---|---|---|---|---|
| 5,795,218 | A * | 8/1998 | Doan et al. | 451/526 |
| 5,882,251 | A | 3/1999 | Berman et al. | |
| 5,984,769 | A * | 11/1999 | Bennett et al. | 451/527 |
| 6,099,394 | A * | 8/2000 | James et al. | 451/72 |
| 6,241,596 | B1 | 6/2001 | Osterheld et al. | |
| 6,273,806 | B1 * | 8/2001 | Bennett et al. | 451/527 |
| 6,340,325 | B1 | 1/2002 | Chen et al. | |
| 6,520,847 | B2 | 2/2003 | Osterheld et al. | |
| 6,634,936 | B2 | 10/2003 | Jensen et al. | |
| 6,648,734 | B2 | 11/2003 | Chin et al. | |
| 6,648,743 | B1 | 11/2003 | Burke | |
| 6,659,846 | B2 | 12/2003 | Misra et al. | |
| 6,685,548 | B2 | 2/2004 | Chen et al. | |
| 6,783,436 | B1 * | 8/2004 | Muldowney | 451/41 |
| 2001/0044263 | A1 * | 11/2001 | Andideh et al. | 451/51 |
| 2003/0092363 | A1 | 5/2003 | Laursen et al. | |

* cited by examiner

*Primary Examiner*—Lee D. Wilson

(57) ABSTRACT

A chemical mechanical polishing (CMP) pad is provided. The CMP pad includes a groove pattern disposed on a polishing surface of the pad. The groove pattern is formed of an alternating sequence of spaced apart grooves. The alternating sequence of grooves comprises a groove of a first size and a groove of a second size, wherein the first and second groove sizes are different relative to one another.

15 Claims, 2 Drawing Sheets

CHEMICAL MECHANICAL POLISHING PAD WITH GROOVES ALTERNATING BETWEEN A LARGER GROOVE SIZE AND A SMALLER GROOVE SIZE

FIELD OF THE INVENTION

This invention relates generally to the field of semiconductor device fabrication, and more particularly to the field of chemical mechanical polishing of semiconductor wafers, and specifically to an improved polishing pad for chemical mechanical polishing of a semiconductor wafer.

BACKGROUND OF THE INVENTION

The fabrication of microelectronics devices involves the deposition and removal of multiple layers of material on a semiconductor substrate to form active semiconductor devices and circuits. Device densities presently exceed 9 million transistors per square centimeter, and they are expected to increase by an order of magnitude within the next decade. Such devices utilize multiple layers of metal and dielectric materials that can selectively connect or isolate device elements within a layer and between layers. Integrated circuits using up to six levels of interconnects have been reported and even more complex circuits are expected in the future. Device geometries have gone from 0.5 micron to 0.12 micron and will soon be 0.08 micron. Multi-levels of metallization are required in such devices to achieve the desired speeds, and each inter-metal level must be planarized during the manufacturing process. A known process with the ability to create a sufficiently planar surface is chemical mechanical polishing (CMP). CMP may be used to remove high topography and/or to remove defects, scratches or embedded particles from the surface of a semiconductor wafer as part of the manufacturing process.

The CMP process generally involves rubbing a surface of a semiconductor wafer against a polishing pad under controlled pressure, temperature and rotational speed in the presence of a chemical slurry. An abrasive material is introduced between the wafer and the polishing pad, either as particles affixed to the polishing pad itself or in fluid suspension in the chemical slurry. The abrasive particles may be, for example, alumina or silica. The chemical slurry may contain selected chemicals, which function together with the abrasive to remove a portion of the surface of the wafer in a polishing action. The slurry also provides a temperature control function and serves to flush the polishing debris away from the wafer.

One important goal of CMP is achieving uniform planarity of the substrate surface. Uniform planarity includes the uniform removal of material from the surface of substrates as well as removing non-uniform layers that have been deposited on the substrate. Successful CMP also requires process repeatability from one substrate to the next. Thus, uniformity must be achieved not only for a single substrate, but also for a series of substrates processed in a batch.

One factor that contributes to non-uniform polishing is non-uniform distribution of the slurry at the interface of the substrate and the polishing pad. One known technique to alleviate the problem of poor slurry distribution has been to provide grooves in the pad. The grooves are believed to control the distribution of the slurry during operation by retaining a portion of the slurry in the grooves. However, while such pad designs accommodate more slurry volume than flat or planar pads, the pads have proved somewhat ineffective in achieving uniformity in slurry distribution because the inertia of the slurry causes the slurry to flow radially outward and off of the pad during rotation of the pad.

In an attempt to achieve uniform distribution of fresh slurry to all areas of the substrate, conventional techniques generally rely on supplying a relatively large volume of slurry to the pad during a polishing cycle. As a result, slurry becomes one primary consumable in chemical mechanical polishing and a significant source of the cost of operation. In order to reduce the cost of operation, the volume of slurry used in a processing cycle should be reduced. However, as noted above, conventional grooved pads generally are not capable of efficiently retaining the slurry between the pad and the substrate. As a result, the volume of consumed slurry is higher than is desirable.

Another issue, due to the presence of grooves on the polishing surface of a pad, can be mechanical effects that can affect the polishing characteristics of the pad. For example, the provision of grooves on the polishing surface can decrease the stiffness of the pad to an unacceptably low level, resulting in poor within-die uniformity.

Thus, it is desirable to provide a pad construction that would allow for an appropriate balance between rigidity (or stiffness) and compliance (or flexibility) of the polishing pad to ensure within-die uniformity. Moreover, it is desirable to provide a pad construction capable of reducing the cost of operation, such as by reducing the volume of slurry used in a processing cycle, as well as reducing a defect count, (e.g., number of scratches) that can develop over the surface of a wafer subjected to a CMP process.

BRIEF SUMMARY OF THE INVENTION

Generally, the present invention fulfills the foregoing needs by providing in one aspect thereof, a chemical mechanical polishing (CMP) pad. The CMP pad includes a groove pattern disposed on a polishing surface of the pad. The groove pattern is formed of an alternating sequence of spaced apart grooves. The alternating sequence of grooves comprises a groove of a first size and a groove of a second size, wherein the first and second groove sizes are different relative to one another.

In another aspect thereof, the present invention further fulfills the foregoing needs by providing a chemical mechanical polishing system including a carrier for holding and moving a semiconductor wafer during a chemical mechanical polishing process. The polishing system includes a rotatable platen, and a chemical mechanical polishing pad supported by the platen. A groove pattern is disposed on a polishing surface of the pad. The groove pattern may comprise an alternating sequence of spaced apart concentric grooves. The alternating sequence of concentric grooves comprises a groove of a first size and a groove of a second size, wherein the first and second groove sizes are different relative to one another.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
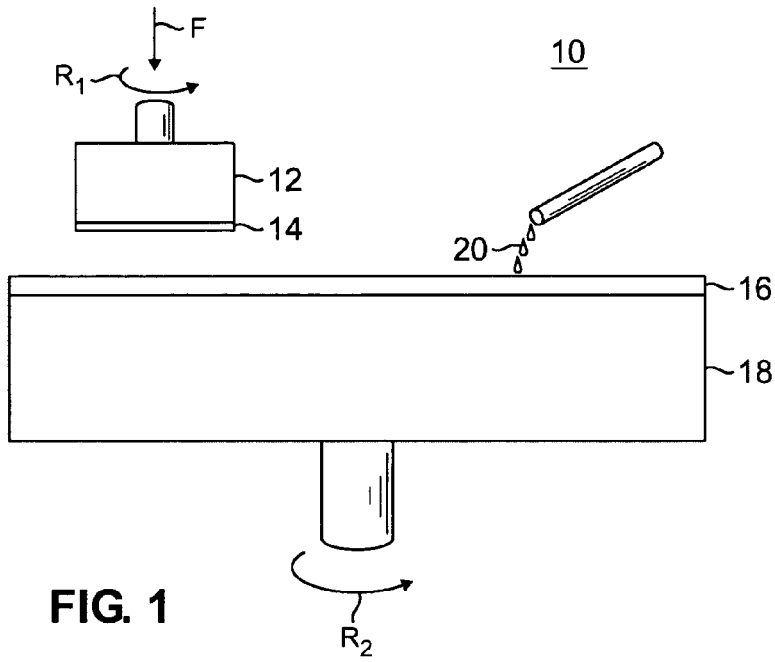
FIG. 1 illustrates a schematic representation of an exemplary chemical mechanical polishing (CMP) system that may benefit from aspects of the present invention.

A chemical mechanical polishing (CMP) system 10 may include a carrier 12 for holding and moving a semiconductor wafer 14 against a polishing pad 16 embodying aspects of the present invention, as described below. The polishing pad 16 may be supported on a rotatable platen 18. A slurry 20 is used to provide the desired chemical interaction and abrasion when the wafer 14 is pressed and rotated against the polishing pad 16. As is known in the art, the rate of material removal from the wafer 14 will depend upon many variables, including the amount of force F exerted between the wafer 14 and the polishing pad 16, the speed of rotation $R_1$ of the carrier, the speed of rotation R2 of the platen, the transverse location of the carrier relative to the axis of rotation of the platen, the chemical composition of the slurry, the temperature, and the composition and history of use of the polishing pad. Numerous configurations of CMP machines are known and are available in the industry. One exemplary manufacturer of such CMP machines is Applied Materials, Inc. of Santa Clara, Calif.

A CMP pad is conventionally provided with grooves in its polishing surface for slurry distribution and improved pad-wafer contact. Aspects of the present invention allow providing a CMP pad comprising a groove pattern configured to enhance positive effects on the polishing characteristics of the pad while avoiding or reducing potentially detrimental effects on the polishing characteristics of the pad. Aspects of the present invention allow for balancing various competing effects that can arise in a grooved CMP pad. For example, grooves of increased size tend to decrease the total area available for polishing the semiconductor wafer, thereby decreasing the removal rate of material from the substrate. However, grooves of increased size have been observed to provide beneficial effects, such as providing a lower defect count over the wafer surface, e.g., a lower number of scratches. Further, the stiffness of the pad is affected by the configuration of the grooves. In particular, an appropriate degree of stiffness is needed to ensure within-die uniformity. This refers to the ability of the CMP system to remove features on a local (or non-global) scale across the diameter of the wafer regardless of wafer shape and/or topography across its surface. It is noted, however, that an appropriate degree of compliance (or flexibility) of the polishing pad is desirable to meet planarity requirements across the entire wafer. Accordingly, aspects of the present invention allow providing in a single CMP pad a groove pattern configured to balance various competing effects capable of influencing the polishing characteristics of the pad.

Figure 3:
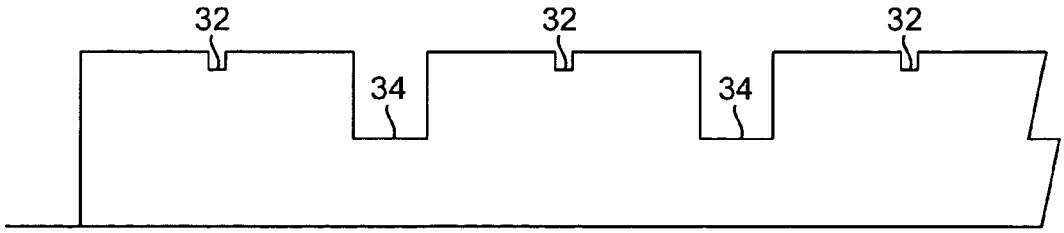
FIG. 3 is a cross-sectional view along cutting plane 3—3 of the polishing pad of FIG. 2.
Figure 2:
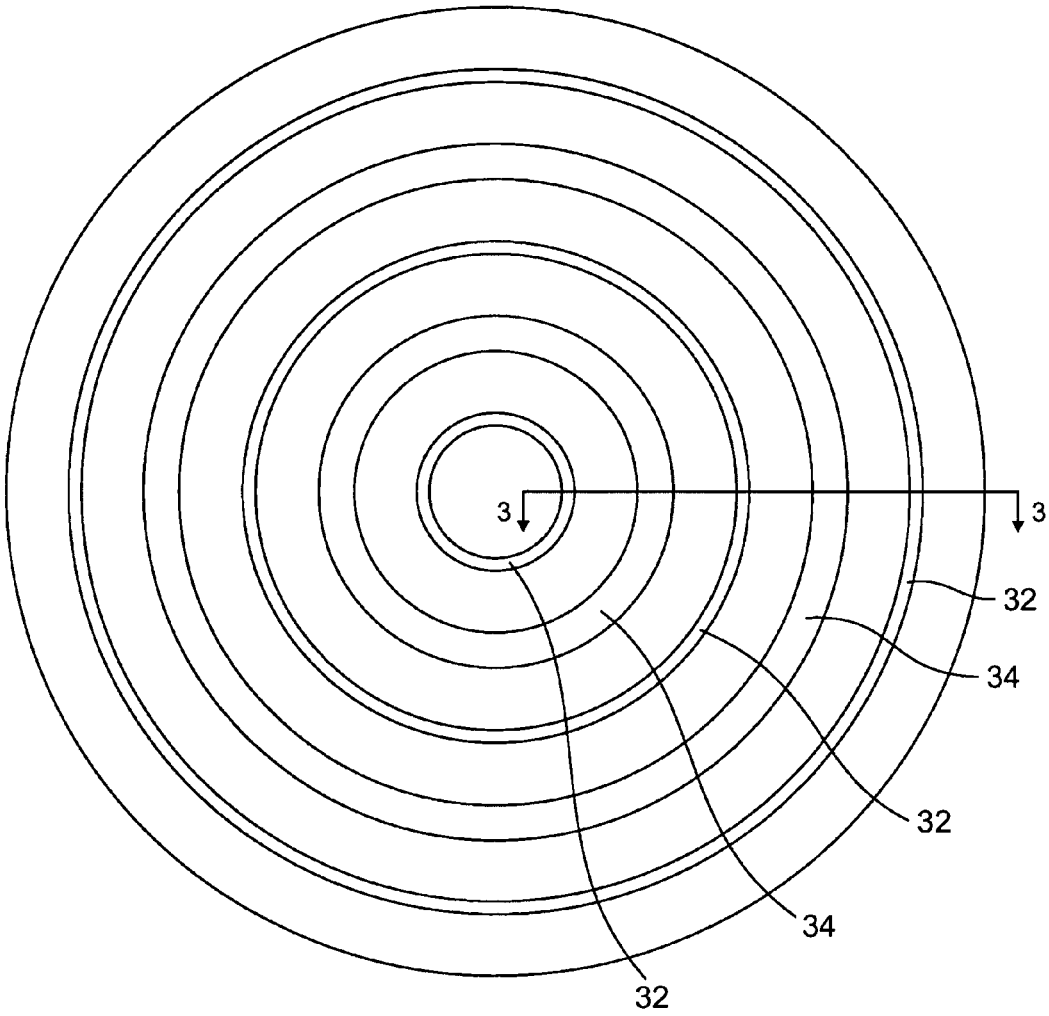
FIG. 2 is a top view of a CMP pad embodying aspects of the present invention.

The inventors of the present invention have observed that improved within-die uniformity (WIDU) and lower defect count may be achieved by providing a polishing pad 16 comprising a grooved pattern 30 that, as illustrated in FIGS. 2 and 3, comprises two distinct types of concentrically disposed grooves. A first of the two groove types, referred to as "mini-grooves," comprises grooves 32 about 5 to 10 mils wide and 1 to 15 mils deep. A second of the two groove types, referred to as "maxi-grooves" comprises grooves 34 about 15 to 60 mils deep by 10 to 60 mils wide. Aspects of the present invention advantageously enhance positive effects respectively provided by the mini- grooves and the maxi-grooves while counter-acting effects that would be present if the maxi-grooves or the mini-grooves were individually provided or not appropriately arranged. For example, it has been observed that the maxi-grooves, in addition to providing a lower-defect count, tend to use relatively less slurry as compared to a grooved pattern just comprising mini-grooves. Conversely, mini-grooves provide a relatively stiffer CMP pad as compared to a grooved pattern just comprising maxi-grooves. As noted above, a relatively stiffer CMP pad provides improved within-die planarity. Accordingly, in one exemplary embodiment, a grooved pattern embodying aspects of the present invention comprises a circumferentially alternating sequence of a mini-groove followed by a maxi-groove. This concentric sequence of alternating maxi-grooves and mini-groves is uniformly repeated as the concentric groves are spaced apart relative to the center of the CMP pad.

In one exemplary embodiment groove pitch may range from about 20 mils to about 80 mils depending on the requirements of the specific application. Pitch of the grooved pattern may be calculated as the average of mini-groove and maxi-groove pitch. Depth of the grooved pattern may be calculated as the average of mini- and maxi-groove depth. Width of the grooved pattern may be calculated as the average of mini- and maxi-groove width.

In operation, a CMP pad comprising staggered mini- and maxi-grooves, as described above, exhibits the type of superior slurry transport normally associated with larger size grooves plus the type of superior planarity normally associated with smaller size grooves. The foregoing exemplary embodiments comprise concentric grooves. It is contemplated, however, that CMP pads comprising other groove geometrical arrangements or patterns may benefit from a staggered arrangement of mini- and maxi-grooves. Examples of such geometrical arrangements may include orthogonally disposed grooves (X-Y oriented grooves), radially extending grooves, and a spiral arrangement of grooves.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A chemical mechanical polishing pad comprising:

a groove pattern disposed on a polishing surface of the pad, said groove pattern comprising repetitive sequence of spaced apart groove pairs, each of said groove pairs comprising a groove of a first size positioned adjacent to a groove of a second size, wherein the first and second groove sizes are different in size relative to one another, whereby only grooves of different size are adjacent to one another in said groove pattern.

2. The chemical mechanical polishing pad of claim 1 wherein a groove of the first size comprises a width that ranges from about 5 mils to about 10 mils.

3. The chemical mechanical polishing pad of claim 1 wherein a groove of the first size comprises a depth that ranges from about 1 mil to about 15 mils.

4. The chemical mechanical polishing pad of claim 1 wherein a groove of the second size comprises a width that ranges from about 10 mils to about 60 mils.

5. The chemical mechanical polishing pad of claim 1 wherein a groove of the second size comprises a depth that ranges from about 15 mils to about 60 mils.

6. The chemical mechanical polishing pad of claim 1 wherein said alternating sequence of grooves comprises a pitch that ranges from about 20 mils to about 80 mils.

7. The chemical mechanical polishing pad of claim 1 wherein said groove pattern affects distribution of a slurry between the polishing surface of the pad and a semiconductor wafer in engagement with said polishing pad, said distribution resulting in a relatively lesser amount of the slurry being used during a chemical mechanical polishing process.

8. The chemical mechanical polishing pad of claim 1 wherein the groove pattern is selected from the group consisting of a concentric groove pattern, an X-Y groove pattern, a radially extending groove pattern and a spiral groove pattern.

9. A chemical mechanical polishing system including a carrier for holding and moving a semiconductor wafer during a chemical mechanical polishing process, the polishing system comprising:

a rotatable platen; and a chemical mechanical polishing pad supported by said platen, a groove pattern disposed on a polishing surface of the pad, said groove pattern comprising repetitive sequence of spaced apart concentric groove pairs, each of said concentric groove pairs comprising a groove of a first size positioned adjacent to a groove of a second size, wherein the first and second groove sizes are different in size relative to one another, whereby only grooves of different size are adjacent to one another in said groove pattern.

10. The chemical mechanical polishing system of claim 9 wherein a groove of the first size comprises a width that ranges from about 5 mils to about 10 mils.

11. The chemical mechanical polishing system of claim 9 wherein a groove of the first size comprises a depth that ranges from about 1 mil to about 15 mils.

12. The chemical mechanical polishing system of claim 9 wherein a groove of the second size comprises a width that ranges from about 10 mils to about 60 mils.

13. The chemical mechanical polishing system of claim 9 wherein a groove of the second size comprises a depth that ranges from about 15 mils to about 60 mils.

14. The chemical mechanical polishing system of claim 9 wherein said alternating sequence of concentric grooves comprises a pitch that ranges from about 20 mils to about 80 mils.

15. The chemical mechanical polishing system of claim 9 wherein said groove pattern affects distribution of a slurry between the polishing surface of the pad and a semiconductor wafer in engagement with said polishing pad, said distribution resulting in a relatively lesser amount of the slurry being used during a chemical mechanical polishing process.

* * * * *